US012233299B1

(12) United States Patent
Chen

(10) Patent No.: US 12,233,299 B1
(45) Date of Patent: Feb. 25, 2025

(54) WEIGHT TRAINING SLED WITH ENHANCED LOAD EFFECT

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 67 days.

(21) Appl. No.: 18/452,879

(22) Filed: Aug. 21, 2023

(51) Int. Cl.
*A63B 21/00* (2006.01)
*A63B 21/06* (2006.01)
*A63B 22/20* (2006.01)
*A63B 23/04* (2006.01)

(52) U.S. Cl.
CPC ..... *A63B 21/0004* (2013.01); *A63B 21/06* (2013.01); *A63B 22/20* (2013.01); *A63B 23/047* (2013.01)

(58) Field of Classification Search
CPC ... A63B 22/20; A63B 22/2021; A63B 22/203; A63B 22/208
See application file for complete search history.

(56) References Cited

U.S. PATENT DOCUMENTS 4,477,074 A * 10/1984 Bushnell ..... A63B 21/078 482/106
5,810,697 A * 9/1998 Joiner ..... A63B 23/047 482/68
6,761,650 B1 * 7/2004 Dettmann ..... A63B 69/34 473/445
7,156,782 B1 * 1/2007 Krull ..... A63B 21/4029 482/106
D606,611 S * 12/2009 Rogers ..... D21/698
8,617,007 B2 * 12/2013 Gilman ..... A63B 69/0071 473/445
D851,186 S * 6/2019 Kuka ..... D21/691
10,398,927 B2 * 9/2019 Baumler ..... A63B 21/0618
10,874,897 B1 * 12/2020 Eastham, Jr. ..... A63B 22/20
D924,342 S * 7/2021 Bentley ..... D21/686
11,179,591 B1 * 11/2021 Bazargan ..... A63B 69/34
D941,940 S * 1/2022 McIntyre ..... D21/686
2017/0189733 A1 * 7/2017 Bentley ..... A63B 23/047
2020/0101346 A1 * 4/2020 Chen ..... A63B 21/4029
2020/0238127 A1 * 7/2020 Wehrell ..... A63B 21/40

* cited by examiner

*Primary Examiner* — Zachary T Moore
(74) *Attorney, Agent, or Firm* — Egbert, McDaniel & Swartz, PLLC

(57) ABSTRACT

A weight training sled with enhanced load effect is disclosed. The main frame has a first end and a second end remote from each other. Two first wheels, in a rotatable state, disposed at either side of the first end. A second wheel, in a rotatable state, disposed at the second end. The damping structure, disposed on the main frame and connected to the second wheel. An operating handle, erected at the first end of the main frame. An auxiliary push frame, erected at the second end of the main frame with a stand portion and a handlebar portion coupled to the upper end of the stand portion. An enhanced weight load holder, disposed on the handlebar portion, including a stop portion spaced from the handlebar portion, forming a handgrip clearance space. A weight member, placed on the enhanced weight load holder and limited in position by the stop portion.

5 Claims, 4 Drawing Sheets

WEIGHT TRAINING SLED WITH ENHANCED LOAD EFFECT

CROSS-REFERENCE TO RELATED APPLICATIONS

Not applicable.

BACKGROUND OF THE INVENTION

1. Field of the Invention

The present invention relates generally to a weight training device, and more particularly to an innovative structural design of a weight training sled with enhanced load effect.

2. Description of Related Art Including Information Disclosed Under 37 CFR 1.97 and 37 CFR 1.98

The weight training sled referred to in the present invention is an inventive weight training apparatus developed in the recent years. It mainly includes a slide board that loads a weight. A particular example of the loading weight is weight plates. When the user pushes or pulls the slide board, the friction between the slide board and the ground will generate a resistance so as to realize the purpose of weight training. The training intensity can be adjusted by altering the quantity of additional weight. When pushing or pulling the slide board, the slide board and the ground will respectively have frictional wear. Therefore, weight training sleds are unsuitable for indoor use.

In view of the aforementioned problem of the weight training sled, the Industries have developed a weight training sled with wheels. The slide board is additionally configured with four wheels. The movement of the wheels of the slide board can solve the problem of frictional wear of the slide board and the ground, and is therefore suitable for indoor use. The wheels of the aforementioned weight training sled is further configured with a damping structure. When the wheels roll on the ground, the damping structure provides a damping effect, acting as another source of resistance in addition to the weight plates loaded on the slide board. The holding bars is usually erected on the slide board for the user to grip with both hands so as to apply a force to push or pull the weight training sled.

However, in actual application experiences, it is discovered that such prior-art weight training sled still has the following problems. For example, the position of the loading weight in the prior-art weight training sled is usually limited on the slide plate, and more specifically, one or two bars are erected on the slide plate for weight plates to sleeve in and stack. For this reason, the center of gravity of the loading weight on the prior-art weight training sled cannot be changed. However, when the user pushes the weight training sled, different centers of gravity of the loading weight can also generate different feelings and can train muscles at different parts. Therefore, the prior-art weight training sleds still lack the ability to adjust the position of the loading weight=s center of gravity. This limitation remains a significant technical challenge that requires further improvement and innovation in the relevant industry.

BRIEF SUMMARY OF THE INVENTION

The primary objective of the present invention is to provide a weight training sled with enhanced load effect, aiming to solve the above technical problem and make an innovative breakthrough by developing a new structural design of a weight training sled that is more ideal and practical.

Based on the above objective, the present invention provides a weight training sled with enhanced load effect, comprising: a main frame, comprising a first end and a second end remote from each other; two first wheels, each in a rotatable state, disposed at either side of the first end; a second wheel, in a rotatable state, disposed at the second end, allowing the main frame to be displaced by utilizing the rolling of each of the first wheels and the second wheel; a damping structure, disposed on the main frame and connected to the second wheel to provide a damping effect to retard the rolling of the second wheel; an operating handle, erected at the first end of the main frame; an auxiliary push frame, erected at the second end of the main frame and including a stand portion and a handlebar portion coupled to the upper end of the stand portion; an enhanced weight load holder, disposed on the handlebar portion and including a stop portion spaced from the handlebar portion to form a handgrip clearance space; and a weight member, placed on the enhanced weight load holder and limited in position by the stop portion, thereby varying the center of gravity of the load in the weight training sled. Based on the above innovative structural design and technical features, the present invention is more advantageous than the prior art. The user can choose to load and place the weight member on the enhanced weight load holder, and limit it through the stop portion. In this way, the gravity center of the loading weight of the weight training sled can be changed to meet diversified needs, thus enhancing the function of the invention and providing more practical value.

DETAILED DESCRIPTION OF THE INVENTION

Figure 1:
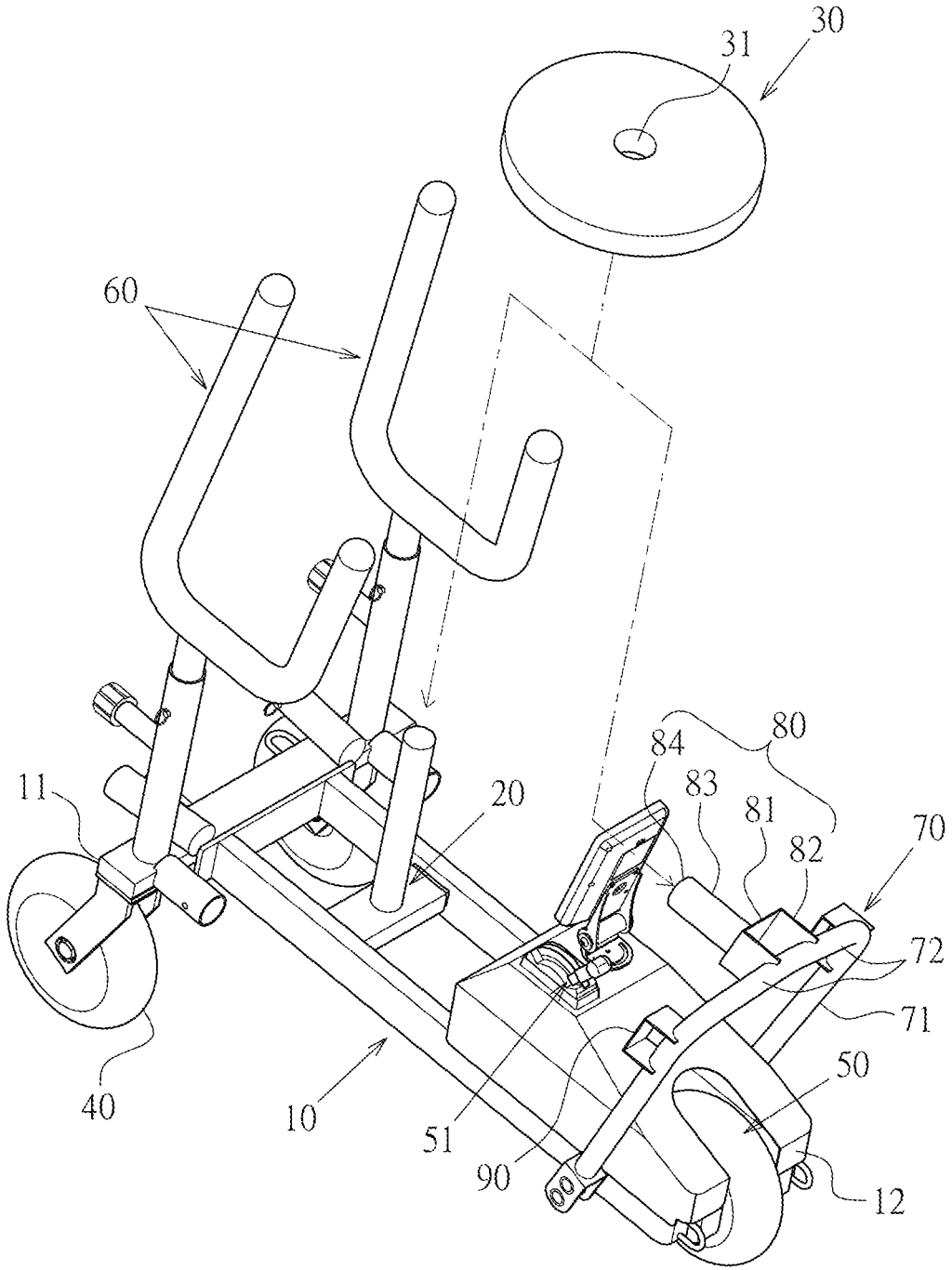
FIG. 1 is a perspective view of a preferred embodiment of the weight training sled according to the invention.

Depicted in FIG. 1 to FIG. 5 is a preferred embodiment of the weight training sled with enhanced load effect according to the invention. However, such an embodiment is for illustrative purpose only, and is not intending to limit the scope of the invention.

The weight training sled comprising of a main frame 10, with a first end 11 and a second end 12 remote from each other. Two first wheels 40, each in a rotatable state, are disposed at either side of the first end 11. A second wheel 50, in a rotatable state, is disposed at the second end 12, allowing the main frame 10 to be displaced by utilizing the rolling of each of the first wheels 40 and the second wheel 50. A damping structure 51 is disposed on the main frame 10 and is connected to the second wheel 50 to provide a damping effect to retard the rolling of the second wheel 50. An operating handle 60 is erected at the first end 11 of the main frame 10. An auxiliary push frame 70 is erected at the second end 12 of the main frame 10 and including a stand portion 71 and a handlebar portion 72 coupled to the upper end of the stand portion 71. An enhanced weight load holder 80 is disposed on the handlebar portion 72 and including a stop portion 81 spaced from the handlebar portion 72 to form a handgrip clearance space H. A weight member 30 is placed on the enhanced weight load holder 80 and limited in position by the stop portion 81, thereby varying the center of gravity of the load in the weight training sled.

Figure 2:
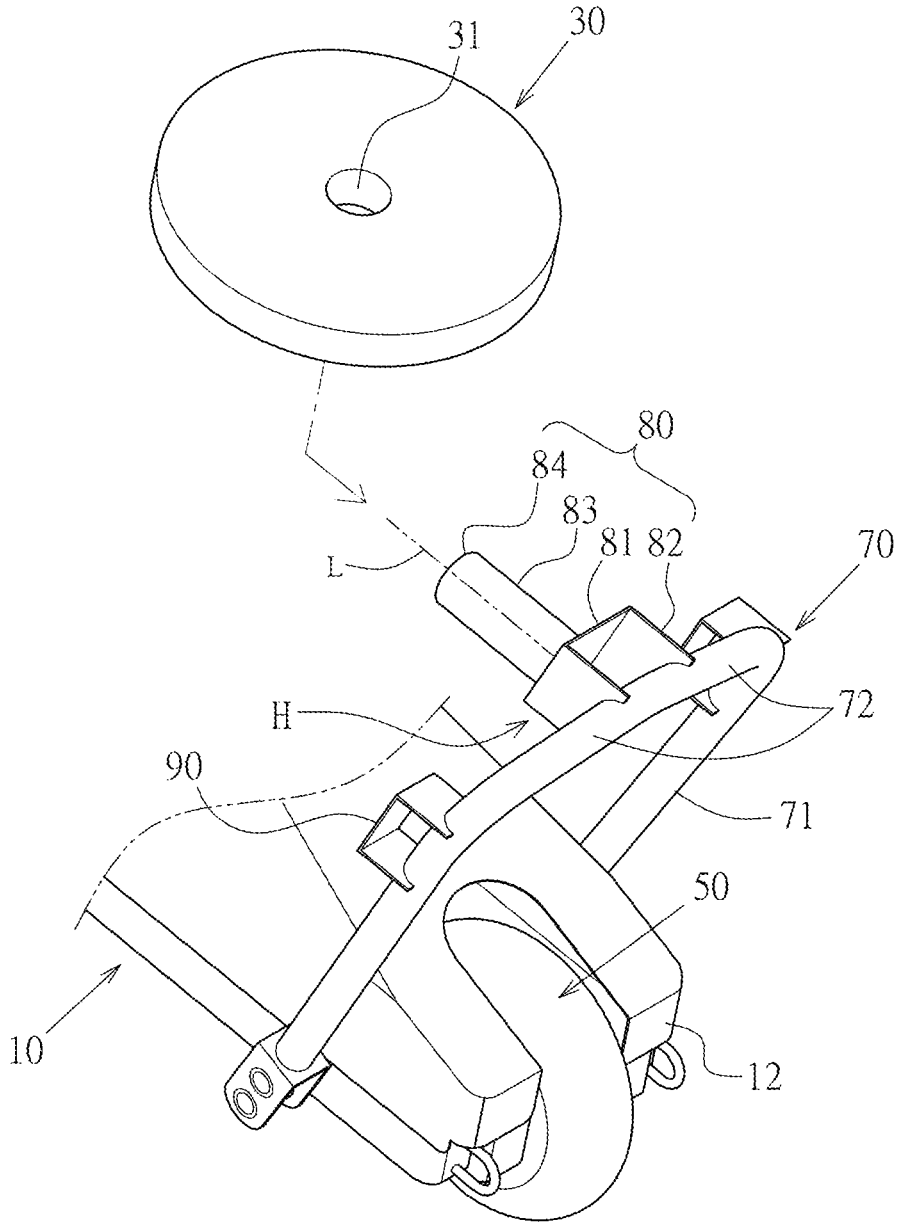
FIG. 2 is an enlarged perspective view of part of the structure of a preferred embodiment of the weight training sled according to the invention.
Figure 3:
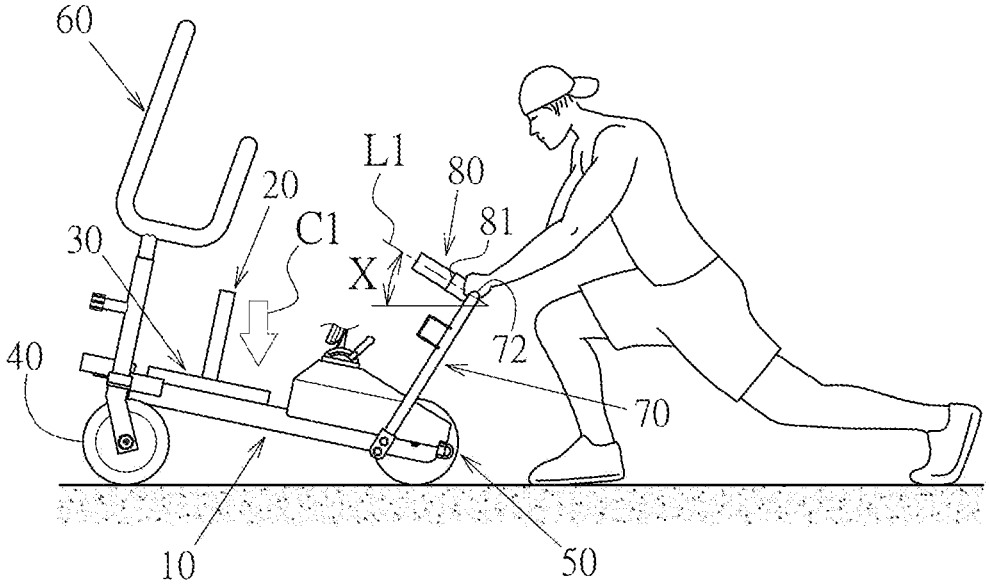
FIG. 3 is usage status view of the weight member placed on the second weight load holder.

Referring to FIG. 2 and FIG. 3, in this embodiment, the main frame 10 is provided with a second weight load holder 20 that allows the user to selectively place the weight member 30 on the second weight load holder 20. The weight member 30 has a perforated hole 31. The second weight load holder 20 is in the form of a rod and in an upright axial orientation for the perforated hole 31 to fit into. The enhanced weight load holder 80 comprises a limit seat 82 and a mounting rod 83, wherein the limit seat 82 is coupled to a handlebar portion 72 and the mounting rod 83 is connected to the limit seat 82. The mounting rod 83 has a protruding end 84 extending in the direction of the operating handle 60 with an inclined axial direction L, and the stop portion 81 is formed at the point where the limit seat 82 and the mounting rod 83 are attached.

Referring to FIG. 3, in this embodiment, the inclined axial direction L of the protruding end 84 of the mounting rod 83 is inclined at an inclination angle X of between 10° and 45°. (Note: said inclination angle is in relation to the horizontal plane.)

Figure 4:
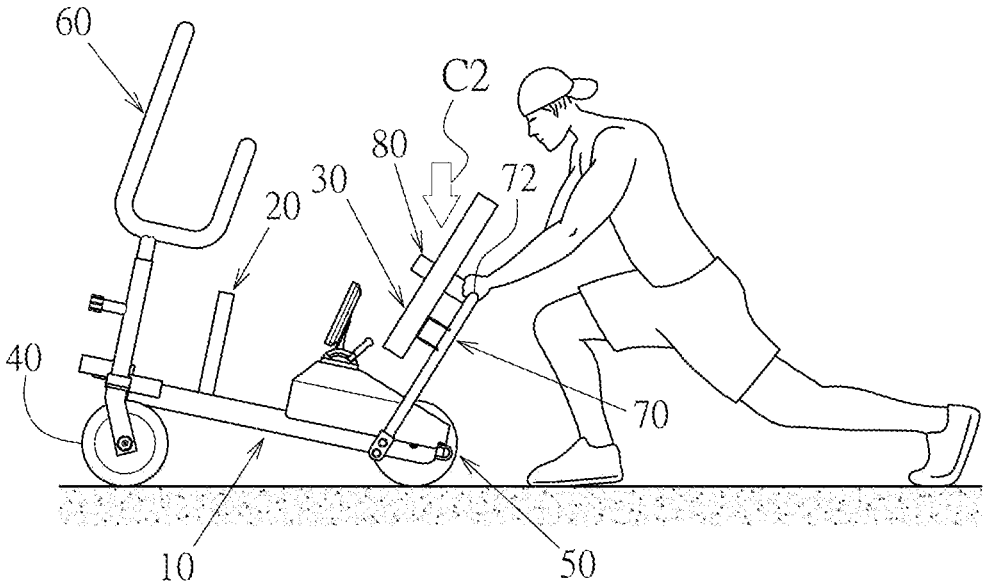
FIG. 4 is a usage status view of the weight member placed on the enhanced weight loading part.

Referring to FIG. 2 and FIG. 4, in this embodiment, the stand portion 71 of the auxiliary push frame 70 is further formed with two auxiliary support seats 90 for the weight member 30 to rest against in a localized area, thereby providing an auxiliary support effect.

Based on the above structural design and technical features, the actual application of the weight training sled with enhanced load effect is described below. Firstly, referring to FIG. 3, when the user choose to place the weight member 30 on the second weight load holder 20, the gravity center of the weight will fall on the main frame 10 (as indicated by Arrow C1).

Figure 5:
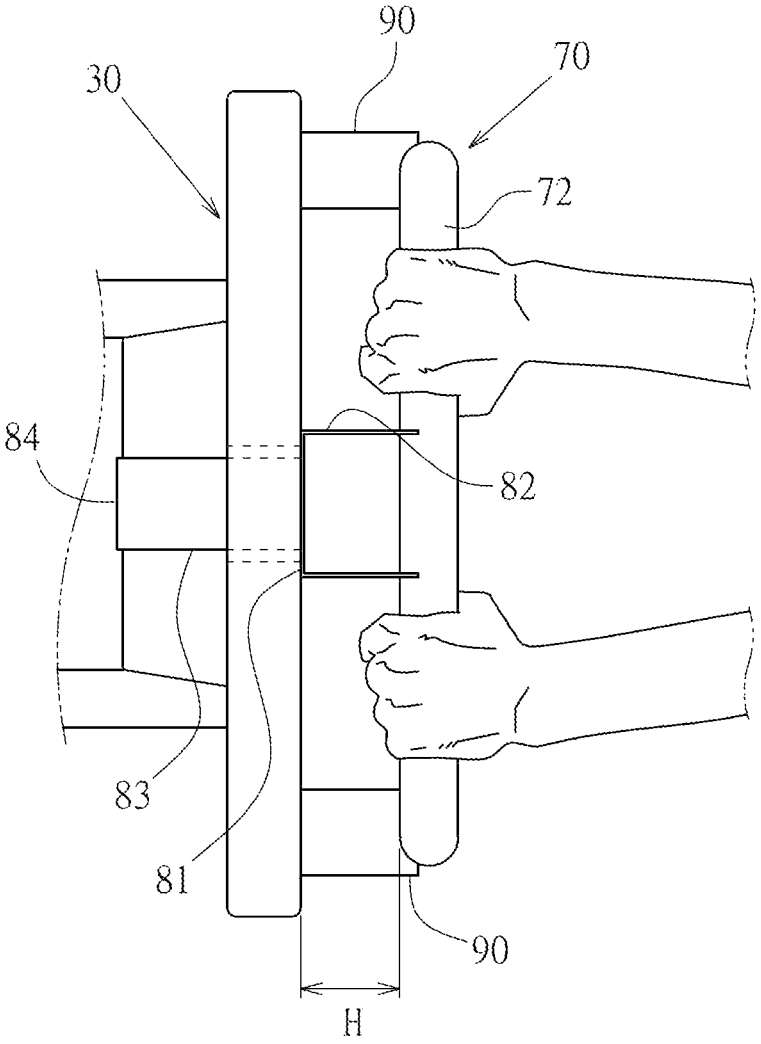
FIG. 5 is a top view of the invention showing the hands of the user gripping the handle bar part.

Moreover, referring to FIG. 4, when the user choose to place the weight member 30 on the enhanced weight load holder 80, the gravity center of the weight will fall on the handlebar portion 72 of the auxiliary push frame 70 (as indicated by Arrow C2). As can be seen, the invention can change the gravity center of the weight of the weight training sled to meet diversified needs, thus enhancing the function and practical value of the product. Furthermore, it is to be noted that the stop portion 81 configured on the enhanced weight load holder 80 is formed with a handgrip avoiding space H in relation to the handlebar portion 72. Thus, when the user grips the handlebar portion 72 with both hands, as shown in FIG. 5, the weight member 30 can be limited by the stop portion 81 ensuring the user's hands are safely held without any compression risk.

I claim:

1. A weight training sled with enhanced load effect comprising:

a main frame, having a first end and a second end remote from each other;

two first wheels, each in a rotatable state, disposed at either side of the first end;

a second wheel, in a rotatable state, disposed at the second end, allowing the main frame to be displaced by utilizing the rolling of each of the first wheels and the second wheel;

a damping structure, disposed on the main frame and connected to the second wheel to provide a damping effect to retard the rolling of the second wheel;

an operating handle, erected at the first end of the main frame;

an auxiliary push frame, erected at the second end of the main frame and including a stand portion and a handlebar portion coupled to the upper end of the stand portion;

an enhanced weight load holder, disposed on the handlebar portion and including a stop portion spaced from the handlebar portion to form a handgrip clearance space H; and a weight member, placed on the enhanced weight load holder and limited in position by the stop portion, thereby varying the center of gravity of the load in the weight training sled.

2. The weight training sled with enhanced load effect according to claim 1, wherein the main frame is provided with a second weight load holder that allows the user to selectively place the weight member on the second weight load holder.

3. The weight training sled with enhanced load effect according to claim 2, wherein, the weight member has a perforated hole; the second weight load holder is in the form of a rod and in an upright axial orientation for the perforated hole to fit into; the enhanced weight load holder comprises a limit seat and a mounting rod, wherein the limit seat is coupled to a handlebar portion and the mounting rod is connected to the limit seat; the mounting rod has a protruding end extending in the direction of the operating handle with an inclined axial direction L, and the stop portion is formed at a point where the limit seat and the mounting rod are attached.

4. The weight training sled with enhanced load effect according to claim 3, wherein the inclined axial direction L of the protruding end of the mounting rod is inclined at an inclination angle X between 10° and 45°.

5. The weight training sled with enhanced load effect according to claim 1, wherein the stand portion of the auxiliary push frame is further formed with two auxiliary support seats for the weight member to rest against in a localized area, thereby providing an auxiliary support effect.

* * * * *